US008091683B2

(12) United States Patent
Tabata

(10) Patent No.: US 8,091,683 B2
(45) Date of Patent: Jan. 10, 2012

(54) MOTORCYCLE

(75) Inventor: Norihito Tabata, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 0 days.

(21) Appl. No.: 12/904,232

(22) Filed: Oct. 14, 2010

(65) Prior Publication Data

US 2011/0088967 A1 Apr. 21, 2011

(30) Foreign Application Priority Data

Oct. 16, 2009 (JP) ..... 2009-239535

(51) Int. Cl.

| | |
|---|---|
| ***F01N 1/00*** | (2006.01) |
| ***F01N 1/08*** | (2006.01) |
| ***F01N 3/00*** | (2006.01) |
| ***F01N 3/02*** | (2006.01) |
| ***F01N 13/08*** | (2010.01) |
| ***F01N 13/18*** | (2010.01) |

(52) U.S. Cl. ..... 181/231; 181/227; 181/241; 181/272; 60/297; 60/322

(58) Field of Classification Search ..... 181/231, 181/241; 60/297, 322

See application file for complete search history.

(56) References Cited

U.S. PATENT DOCUMENTS

| | | | | | |
|---|---|---|---|---|---|
| 3,371,472 | A * | 3/1968 | Krizman, Jr. | ..... | 55/399 |
| 3,677,364 | A * | 7/1972 | Pawlina | ..... | 181/269 |
| 4,119,174 | A * | 10/1978 | Hoffman | ..... | 181/231 |
| 5,509,947 | A * | 4/1996 | Burton | ..... | 96/383 |
| 5,627,351 | A * | 5/1997 | Okuma et al. | ..... | 181/231 |
| 5,869,793 | A * | 2/1999 | Berger et al. | ..... | 181/256 |
| 5,969,299 | A * | 10/1999 | Yamaguchi et al. | ..... | 181/227 |
| 6,467,569 | B2 * | 10/2002 | Noe et al. | ..... | 181/231 |
| 7,287,622 | B2 * | 10/2007 | Rauch et al. | ..... | 181/272 |
| 2002/0096392 | A1 * | 7/2002 | Noe et al. | ..... | 181/231 |
| 2004/0206073 | A1 * | 10/2004 | Yamamoto et al. | ..... | 60/297 |

FOREIGN PATENT DOCUMENTS

| | | | |
|---|---|---|---|
| JP | 10-266828 | A | 10/1998 |
| JP | 2001164920 | A * | 6/2001 |

* cited by examiner

*Primary Examiner* — Elvin G Enad
*Assistant Examiner* — Christina Russell
(74) *Attorney, Agent, or Firm* — Keating & Bennett, LLP

(57) ABSTRACT

A motorcycle includes a spark arrester having an increased surface area without any undue increase in the length of a silencer or the width of the motorcycle. The motorcycle includes a rear wheel and a silencer provided on a side of the rear wheel. The silencer includes an outer tube and a spark arrester which is tubular and is disposed inside the outer tube, the longitudinal axis of the spark arrester being oriented in a longitudinal direction of the outer tube. In a sectional plane which is perpendicular or substantially perpendicular to the longitudinal direction of the outer tube and the spark arrester, the outer tube has an outside dimension in a height direction greater than an outside dimension of the outer tube in a lateral direction, and the spark arrester has an outside dimension in the height direction greater than an outside dimension of the spark arrester in the lateral direction.

10 Claims, 15 Drawing Sheets

MOTORCYCLE

BACKGROUND OF THE INVENTION

1. Field of the Invention

The present invention relates to motorcycles, and more specifically, to a motorcycle equipped with a spark arrester for reduced emission into the atmosphere of smut, etc. contained in the exhaust gas.

2. Description of the Related Art

As disclosed in JP-A Hei 10-266828, for example, a conventional motorcycle may have a mesh of spark arrester inside its silencer in order to reduce emission into the atmosphere of smut, etc., contained in its exhaust gas. The spark arrester is designed to be inserted around an open end of a tail pipe inside a silencer, so that the exhaust gas passes through the spark arrester and then into the tail pipe. In this process, smut, etc. in the exhaust gas are captured by the spark arrester.

According to the motorcycle disclosed in JP-A Hei 10-266828, the silencer includes an outer tube which constitutes an outer wall of the silencer. The outer tube has a circular section, and the spark arrester is also tubular, having a circular section like the outer tube.

The smut, etc. contained in the exhaust gas are gradually accumulated in the spark arrester. Therefore, in order to extend a period of good operating condition in which the exhaust gas makes smooth passing through the spark arrester, it is desirable that the spark arrester has a large surface area.

The surface area of the spark arrester may be increased by increasing the spark arrester's diameter. In this case, however, the outer tube must be increased in its diameter in order to provide a sufficient distance between the spark arrester and the outer tube inner surface. In the above-described conventional motorcycle, the silencer outer tube has a circular section, which means increasing the outer tube diameter leads to an increased width of the motorcycle.

The surface area of the spark arrester may also be increased by increasing the spark arrester's length. In this case, however, the outer tube must be increased in its length in order to avoid interference between the spark arrester and other members disposed inside the outer tube (such as partitioning walls for dividing the inside space of the outer tube into a plurality of expansion chambers, and pipes for connecting the expansion chambers). Generally in motorcycles, a large number of components are disposed within a tight space. Increasing the length of the outer tube increases the difficulty of the layout of the other components. In addition, a longer outer tube must be supported with stronger members.

SUMMARY OF THE INVENTION

Preferred embodiments of the present invention provide a motorcycle which includes a spark arrester having an increased surface area without any undue increase in the length of silencer or the width of the motorcycle.

According to a preferred embodiment of the present invention, a motorcycle includes a rear wheel and a silencer provided on a side of the rear wheel. The silencer includes an outer tube; and a tubular spark arrester disposed inside the outer tube, with a longitudinal axis of the spark arrester oriented in a longitudinal direction of the outer tube. Further, in a sectional plane that is perpendicular or substantially perpendicular to the longitudinal direction of the outer tube and to the spark arrester, the outer tube has an outside dimension in a height direction that is greater than an outside dimension of the outer tube in a lateral direction, and the spark arrester has an outside dimension in the height direction that is greater than an outside dimension of the spark arrester in the lateral direction.

According to a preferred embodiment of the present invention, it is possible to increase the outside dimension of the spark arrester in the height direction, and therefore it is possible to increase the surface area of the spark arrester while reducing an increase in the outside dimension of the spark arrester in the lateral direction. Also, since it is possible to increase the surface area of the spark arrester, there is no need for increasing the length of the spark arrester, which means that it is possible to reduce increase in the length of the outer tube (i.e., the length of the silencer). Further, since it is possible to reduce an increase in the outside dimension of the spark arrester in the lateral direction, it is possible to reduce an increase in the outside dimension of the outer tube in the lateral direction (i.e., the silencer's outside dimension in the lateral direction), and consequently, it is possible to reduce an increase in the width of the motorcycle.

Preferably, the spark arrester has an elliptical sectional shape in the sectional plane. In this case, it is possible to increase the surface area of the spark arrester compared to those spark arresters which have a true-circle section of a diameter equal to the outside dimension of the spark arrester in the lateral direction.

Further preferably, the outer tube includes an opening in its rear portion; the silencer further includes a lid member which is mounted at the rear portion of the outer tube along an edge of the opening and supports the spark arrester inside the outer tube; and the opening is generally elliptical, having a greater dimension in the height direction than a dimension in the lateral direction. In this case, the arrangement provides improved mounting, over cases where the opening is polygonal, such that the lid member can be fastened to the rear portion of the outer tube around the opening, with uniform distribution of fastening forces regardless of positions where the rear portion and the lid member contact each other. The arrangement thus can prevent and minimize a potential gap development between the rear portion of the outer tube and the lid member.

Further, preferably, the outer tube includes an opening in its rear portion, and the silencer further includes a lid member mounted at the rear portion of the outer tube along an edge of the opening and supporting the spark arrester inside the outer tube. The lid member includes at least three mounting portions provided along an outer circumferential edge of the lid member for mounting to the rear portion of the outer tube, and two of the mounting portions which are spaced from each other in the height direction are spaced by a distance greater than a distance between two of the mounting portions which are spaced from each other in the lateral direction. When the motorcycle is running, concomitant up-down movements generate a moment which acts from the spark arrester to the lid member. However, the lid member is supported at the rear portion of the outer tube with mounting portions which are apart from each other by a large distance. The arrangement thus reduces the load acting on each mounting portion, and thereby increases mounting strength of the spark arrester assembly.

Preferably, the outer tube includes an opening in its rear portion, and the opening has a greater dimension in the height direction than a dimension of the opening in the lateral direction. In this case, the arrangement makes it easy to insert the spark arrester through the opening.

Further preferably, the outer tube includes, in its inside space, a first expansion chamber with the spark arrester disposed therein; a second expansion chamber adjacent to the first expansion chamber; a partitioning wall partitioning the first expansion chamber and the second expansion chamber from each other; and a pipe extending in the longitudinal direction of the outer tube and penetrating the partitioning wall. With this arrangement, at least a portion of the spark arrester and the pipe overlap each other when the pipe and the spark arrester are viewed from the longitudinal direction. In this case, exhaust gas from the pipe hits and diffuses on the spark arrester. The arrangement reduces the concentrated flow of exhaust gas through a specific location in the spark arrester, thereby maintaining a good operating condition of the spark arrester for a much longer period of time.

Further, preferably, the pipe is in the height direction from the spark arrester when the pipe and the spark arrester are viewed from the longitudinal direction. In this case, the arrangement makes it possible to increase the area of overlap region made by the pipe and the spark arrester when the pipe and the spark arrester are viewed from the longitudinal direction.

Preferably, the spark arrester includes a front wall portion arranged to not allow exhaust gas to flow through, and at least a portion of the front wall portion opposes an end of the pipe in the longitudinal direction. In this case, exhaust gas from the pipe hits and diffuses further on the front wall portion of the spark arrester.

Further preferably, the outer tube and the spark arrester are disposed coaxially with each other. In this case, the arrangement reduces such regions in the outer circumferential surface of the spark arrester having an excessively small distance to the inner surface of the outer tube, and those regions having an unnecessarily large distance to the inner surface of the outer tube as well.

Further, preferably, the spark arrester preferably has a sectional shape in the sectional plane, relevant to a sectional shape of the outer tube in the sectional plane. In this case, the arrangement reduces, further reliably, such regions in the outer circumferential surface of the spark arrester having an excessively small distance to the inner surface of the outer tube, and those regions having an unnecessarily large distance to the inner surface of the outer tube as well. The arrangement also makes it possible to increase the sectional shape in the sectional plane while maintaining the function as a spark arrester, thereby enabling an increase in the surface area of the spark arrester.

Preferably, the sectional shape of the spark arrester is similar to the sectional shape of the outer tube. In this case, the arrangement reduces, further reliably, such regions in the outer circumferential surface of the spark arrester having an excessively small distance to the inner surface of the outer tube and those regions having an unnecessarily large distance to the inner surface of the outer tube as well.

Further preferably, the spark arrester and the outer tube are spaced from each other in the height direction by a distance which is equal to a distance between the spark arrester and the outer tube in the lateral direction. In this case, the arrangement reduces, further reliably, such regions in the outer circumferential surface of the spark arrester having an excessively small distance to the inner surface of the outer tube and those regions having an unnecessarily large distance to the inner surface of the outer tube as well.

It should be noted here that the expression "a silencer provided on a side of the rear wheel" means that the silencer does not overlap a lateral (width) centerline of the rear wheel in a plan view, but does not require anything further.

The expression "outside dimension of the outer tube in the height direction . . . in the sectional plane" is the longest of the line segments which could be drawn in a height direction (up-down direction) in the sectional plane, to connect a point on the outline of the outer tube in the plane with another. Also, the expression "outside dimension of the outer tube in the lateral direction . . . in the sectional plane" is the longest of the line segments which could be drawn in a lateral direction (left-right direction) in the sectional plane, to connect a point on the outline of the outer tube in the plane with another. The same interpretations should be applied to the expressions "outside dimension of the spark arrester in the height direction . . . in the sectional plane" and the expression "outside dimension of the spark arrester in the lateral direction . . . in the sectional plane."

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, preferred embodiments of the present invention will be described with reference to the drawings.

Figure 1:
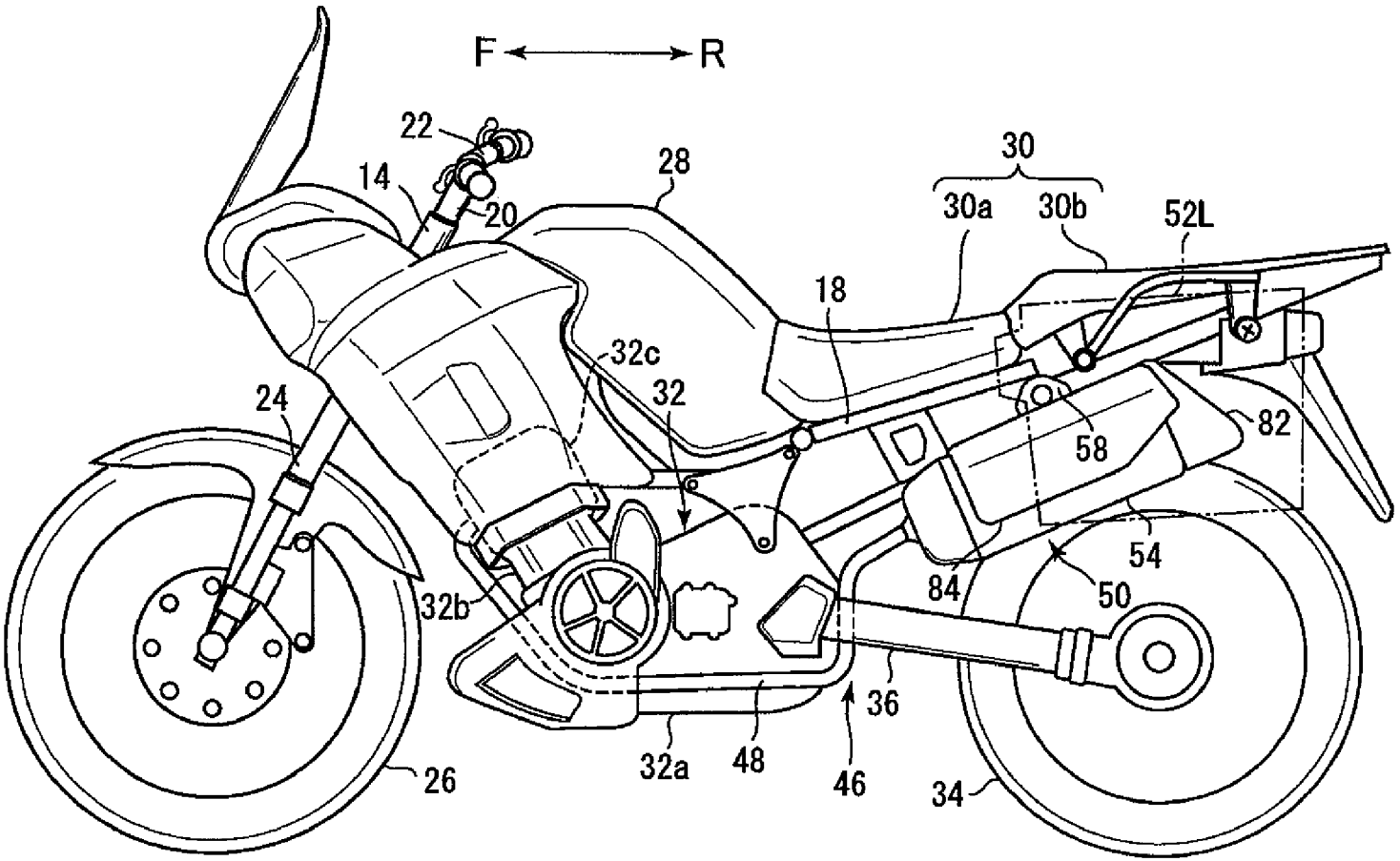
FIG. 1 is a side view of a motorcycle according to a preferred embodiment of the present invention.
Figure 2:
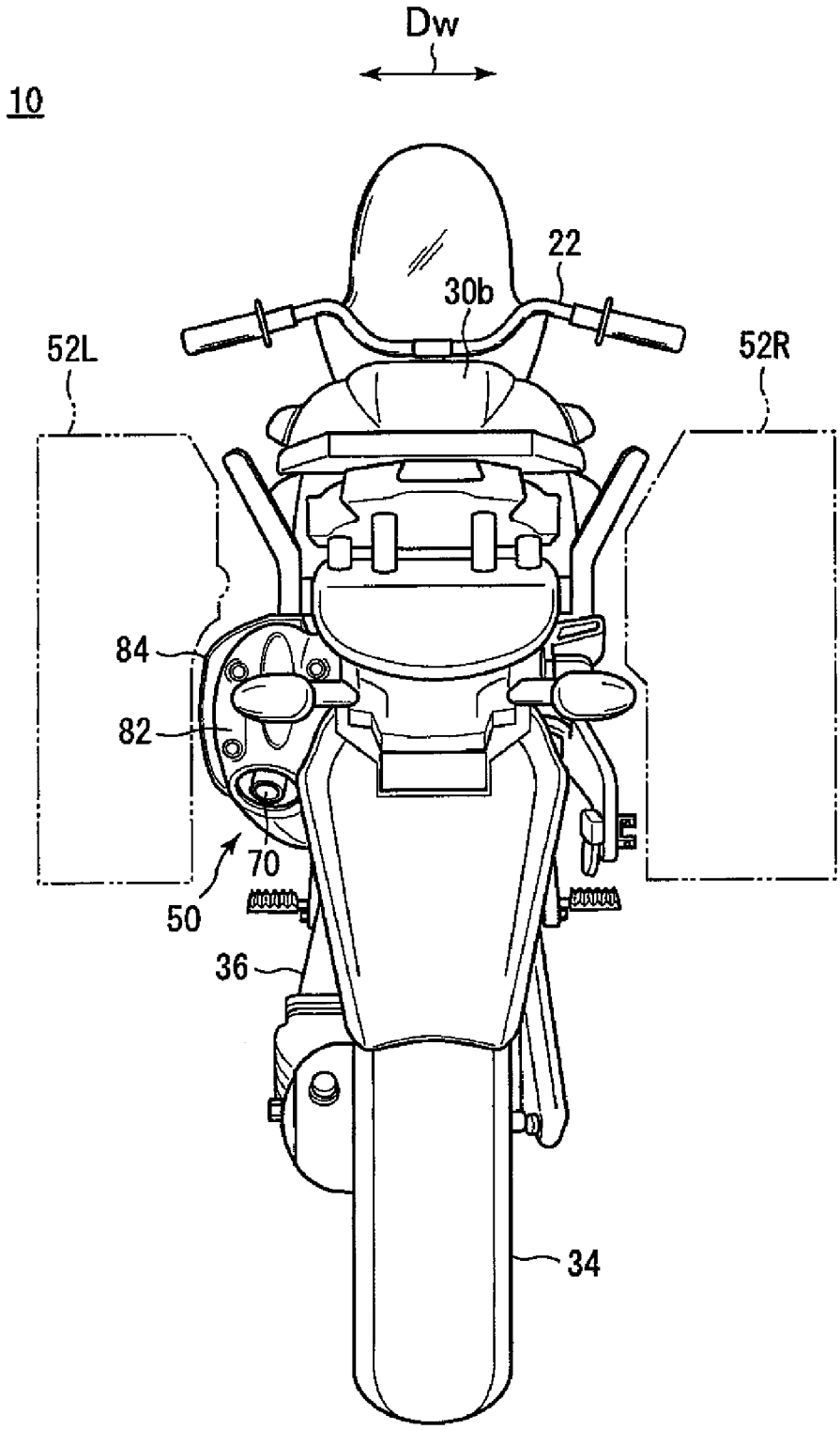
FIG. 2 is a rear view of the motorcycle according to a preferred embodiment of the present invention.
Figure 3:
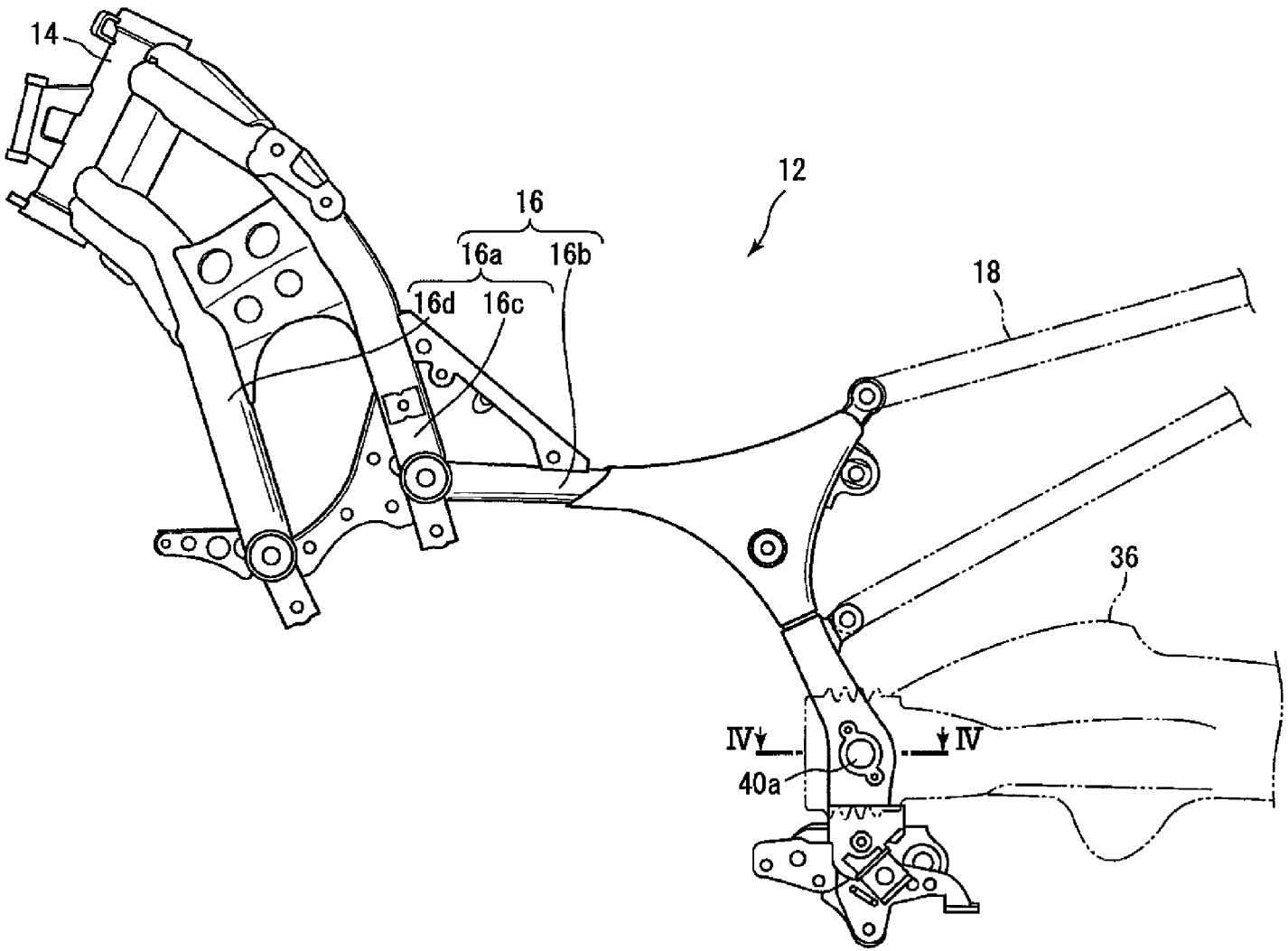
FIG. 3 is a side view of a motorcycle frame.
Figure 4:
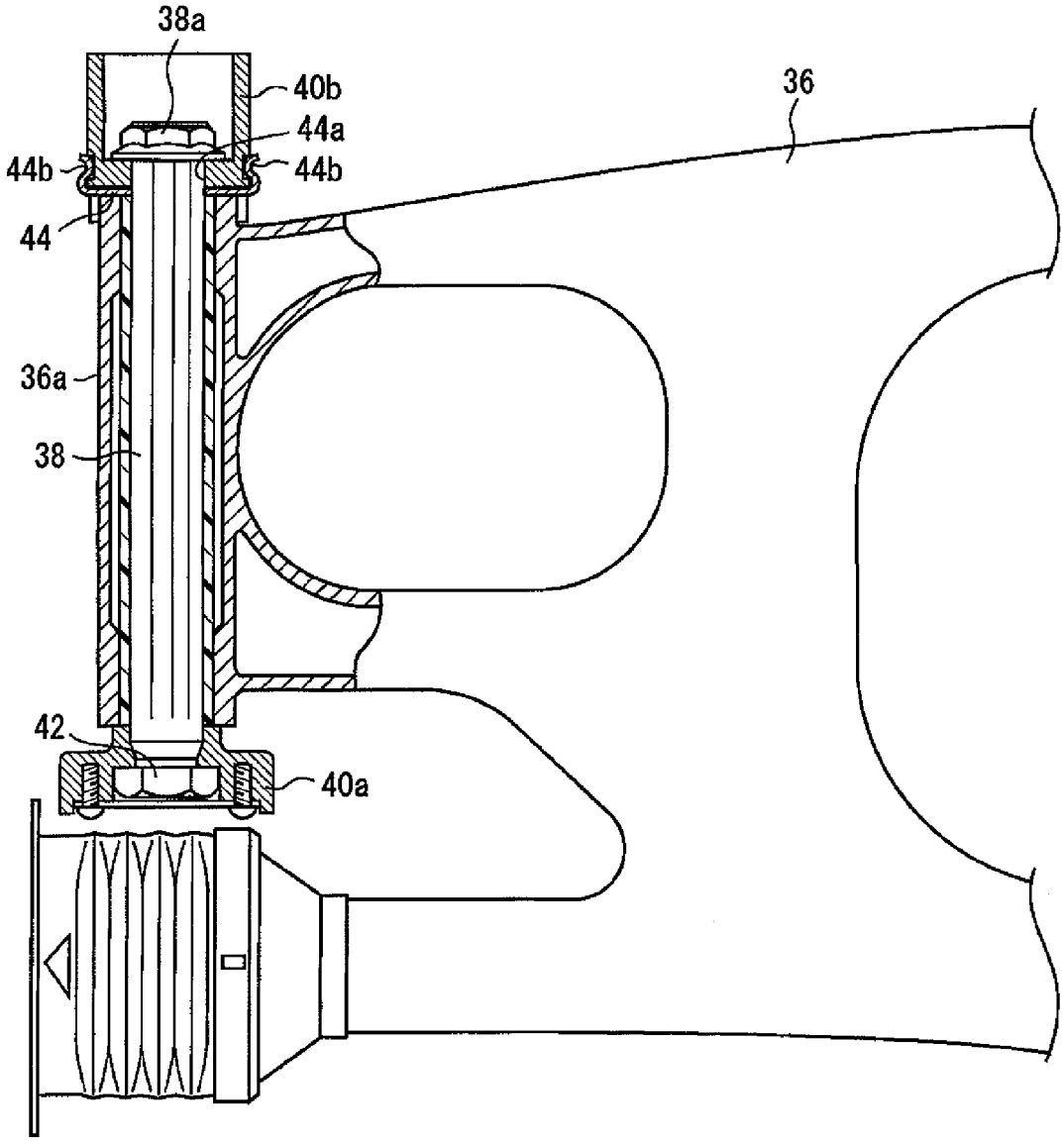
FIG. 4 is a partial sectional view taken in lines IV-IV in FIG. 3.

FIG. 1 is a side view of a motorcycle 10 according to a preferred embodiment of the present invention. FIG. 2 is a rear view of the motorcycle 10. FIG. 3 is a side view of a motorcycle frame 12. FIG. 4 is a sectional view taken in lines IV-IV in FIG. 3.

Referring to FIG. 1 and FIG. 3, a motorcycle 10 includes a motorcycle frame 12.

The motorcycle frame 12 includes a head pipe 14, a main frame 16 and a seat frame 18. The head pipe 14 is at a forefront portion of the motorcycle frame 12. The main frame 16 extends from the head pipe 14 in an obliquely rearward and downward direction. The main frame 16 includes a left-and-right pair of front frames 16*a*, and a left-and-right pair of rear frames 16*b*. The front frames 16*a* are connected with the head pipe 14. Each of the rear frames 16*b* extends rearward from a corresponding one of the front frames 16*a*, then curves and extends downward. The front frame 16*a* includes an upper tube 16*c* which connects with an upper portion of the head pipe 14, and a lower tube 16*d* which connects with a lower portion of the head pipe 14. The upper tube 16*c* and the lower tube 16*d* are arranged substantially in a fore-aft direction. The seat frame 18 supports a seat 30 (to be described later) from below.

As shown in FIG. 1, the head pipe 14 rotatably supports a steering stem 20. The steering stem 20 includes an upper end portion, to which a handlebar 22 is fixed. The steering stem 20 includes a lower end portion, to which a front fork 24 is connected. The front fork 24 includes a lower end portion, which supports a front wheel 26. The handlebar 22 is pivotable together with the front fork 24 and the front wheel 26 in left and right directions around the steering stem 20.

A fuel tank 28 is disposed behind the handle bar 22. Behind the fuel tank 28, there is provided a seat 30 for the rider and a passenger to ride on. In the present preferred embodiment, the seat 30 preferably includes a front seat 30*a* for the motorcycle rider, and a rear seat 30*b* disposed behind the front seat 30*a* for the passenger, for example. Below the fuel tank 28, an engine 32 is disposed. The engine 32 is suspended by the main frame 16.

A rear wheel 34 is disposed behind the engine 32. Referring to FIG. 2, the rear wheel 34 is located at a center of width of the motorcycle 10 (in the width direction indicated by Dw in FIG. 2). Driving power from the engine 32 is transmitted to the rear wheel 34 via a drive shaft (not illustrated) housed in a swing arm 36 which extends in a fore-aft direction from behind the engine 32.

Referring to FIG. 4, the swing arm 36 includes a fore end which is supported by the motorcycle frame 12 via a pivot 38. More specifically with reference to FIG. 3 and FIG. 4, pivot supports 40*a*, 40*b* are provided at a lower portion of the rear frame 16*b* to support the pivot 38. As shown in FIG. 4, the swing arm 36 includes a fore end provided with a tube portion 36*a* which extends in the motorcycle's width direction. The tube portion 36*a* is disposed between the left and right pivot supports 40*a*, 40*b*. With this arrangement, the pivot 38 is inserted through holes of the pivot supports 40*a*, 40*b* and the tube portion 36*a* of the swing arm 36. The pivot 38 is threaded by a nut 42, thereby fixed to the pivot supports 40*a*, 40*b*. The pivot supports 40*a*, 40*b* and the tube portion 36*a* of the swing arm 36 are captured by and between a head 38*a* of the pivot 38 and the nut 42. Thus, the rear wheel 34 and the swing arm 36 are pivotable around the pivot 38 in an up-down direction with respect to the motorcycle frame 12 and the engine 32.

There may be a gap between the tube portion 36*a* of the swing arm 36 and the pivot supports 40*a*, 40*b* due to manufacturing tolerance. In the present preferred embodiment, the right pivot support 40*b* is fixed to the rear frame 16*b* by welding, and there may be a gap between the tube portion 36*a* of the swing arm 36 and the pivot support 40*b* due to welding tolerance. In the motorcycle 10, a shim 44 is preferably used to compensate for such a manufacturing tolerance.

Figure 5:
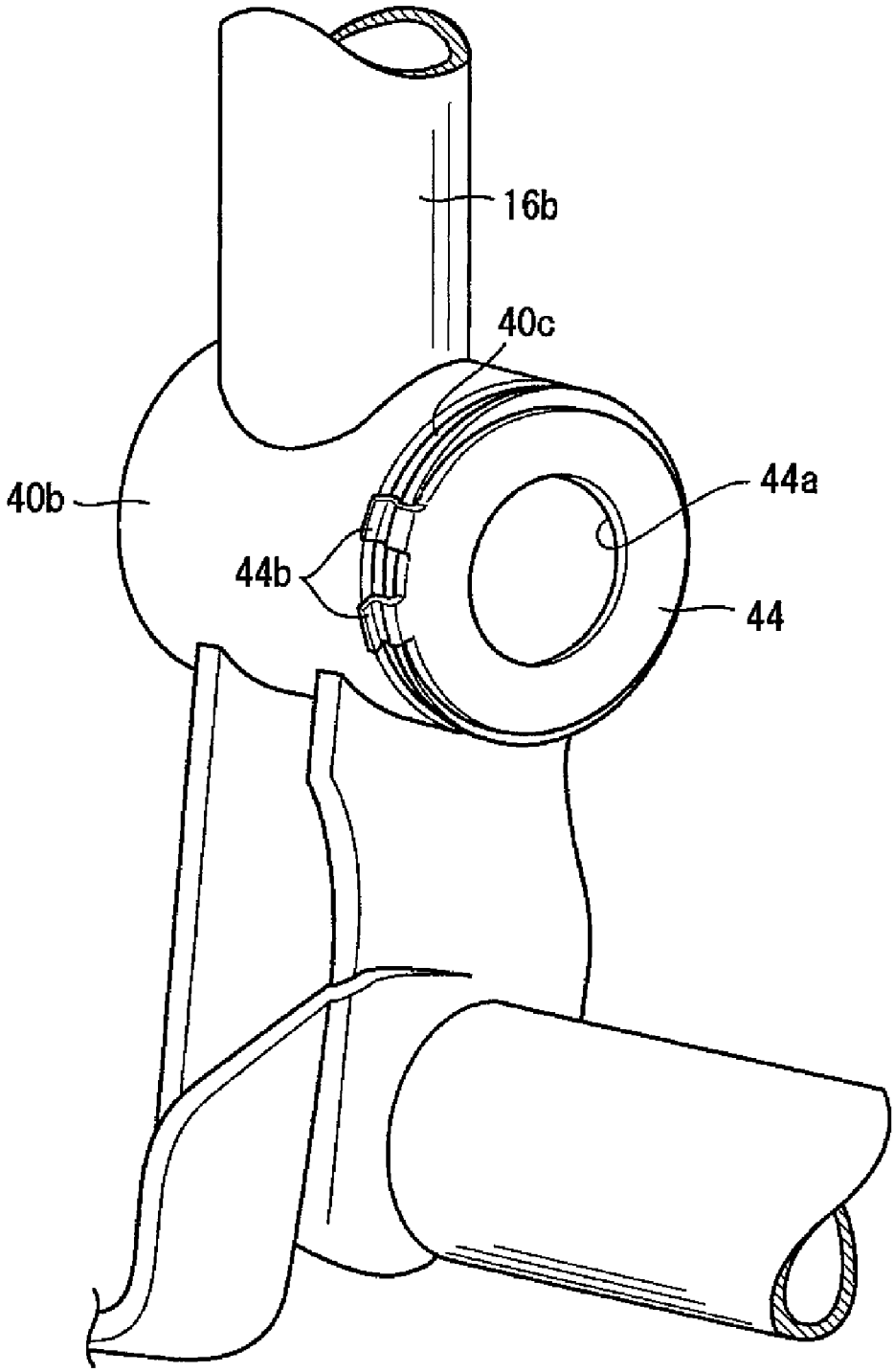
FIG. 5 is a perspective view of pivot supports and their surroundings.

FIG. 5 is a perspective view when the right pivot support 40*b* is viewed from an obliquely forward direction. As shown in FIG. 4 and FIG. 5, the shim 44 preferably is a doughnut-shaped disc member, for example, attached to a side surface of the pivot support 40*b*, between the tube portion 36*a* of the swing arm 36 and the pivot support 40*b*. The shim 44 includes a through-hole 44*a* opening in the width direction of the motorcycle, and the pivot 38 is inserted through the hole 44*a*.

As shown in FIG. 5, the shim 44 includes an edge including a plurality of pawl portions 44*b* protruding toward the pivot support 40*b*. The shim 44 holds an end of the pivot support 40*b* with its pawl portions 44*b* from radially outward directions. In the present preferred embodiment, as shown in FIG. 5, the pivot support 40*b* includes an outer circumferential surface including a groove 40*c*, and the pawl portions 44*b* catch the groove 40*c*. The arrangement prevents the shim 44 from falling off the pivot support 40*b* during manufacture of the motorcycle 10 even before the pivot 38 is inserted. Also, even after the swing arm 36 has been assembled to the main frame 16, the pawl portions 44*b* are still visible by workers, which helps them determine whether or not the shim 44 has been provided, by checking whether or not the pawl portions 44*b* are present. It should be noted here that the shim 44 is preferably attached only to the right pivot support 40*b* in the present preferred embodiment. However, the shim 44 may also be attached to the left pivot support 40*a* depending on looseness of the manufacturing tolerance.

As shown in FIG. 1, the engine 32 includes a crank case 32*a*, a cylinder block 32*b* and a cylinder head 32*c*. The cylinder block 32*b* is provided at a front portion of an upper surface of the crank case 32*a* whereas the cylinder head 32*c* is provided on the cylinder block 32*b*. The cylinder block 32*b* and the cylinder head 32*c* are raised in a forward leaning attitude.

The engine 32 is connected with exhaust equipment 46. The exhaust equipment 46 releases exhaust gas from the engine 32 in a rearward direction of the motorcycle 10. The exhaust equipment 46 includes an exhaust pipe 48 and a silencer 50. The exhaust pipe 48 is connected with the engine 32, to let the exhaust gas flow to the rear portion of the motorcycle 10. The silencer 50 is connected with the exhaust pipe 48, allows the exhaust gas to expand and then exit in the rearward direction of the motorcycle 10. In the present preferred embodiment, the exhaust pipe 48 has its forward end connected with the cylinder head 32*c*, and extends in an obliquely downward and rearward direction in front of the cylinder head 32*c* and the cylinder block 32*b*. Then, the exhaust pipe 48 extends in a rearward direction near a lower portion of the crank case 32*a*. Thereafter, the exhaust pipe 48 bends upward and extends further. The exhaust pipe 48 ends with its rear end inside the silencer 50.

Referring to FIG. 1 and FIG. 2, the silencer 50 is preferably located on a side of the rear wheel 34, which is disposed at the center of width of the motorcycle 10. In the present preferred embodiment, the silencer 50 is disposed so that the silencer 50 has its lower portion overlapping an upper portion of the rear wheel 34 in a side view of the motorcycle 10. It should be noted, however, that the position of the silencer 50 is not limited to this. For example, the entire silencer 50 may be disposed at a higher position than the rear wheel 34, or the entire silencer 50 may be disposed at a position which is lower than the highest portion of the rear wheel 34, as long as the silencer 50 does not overlap a lateral (width) centerline of the rear wheel 34 in a plan view.

As shown in FIG. 1 and FIG. 2, the motorcycle 10 can be equipped with side cases 52L, 52R for storing various items. In the present preferred embodiment, the side cases 52L, 52R are disposed on the left and the right sides of the rear seat 30*b* respectively, and supported by the seat frame 18. Referring to FIG. 2, with the left side case 52L mounted to the motorcycle 10, the silencer 50 is between the side case 52L and the rear wheel 34.

Figure 6:
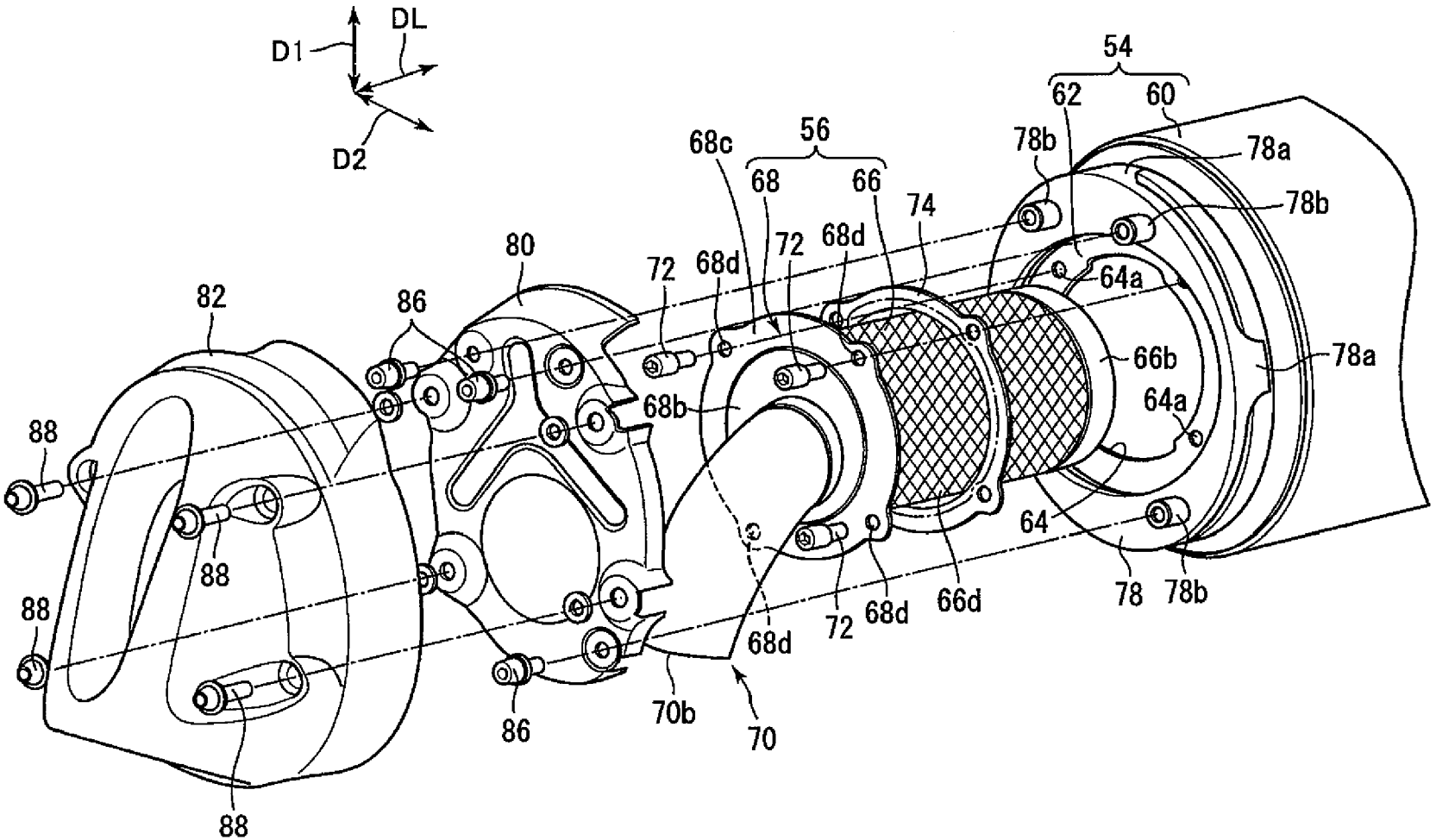
FIG. 6 is an exploded perspective view showing a rear portion of a silencer.
Figure 7:
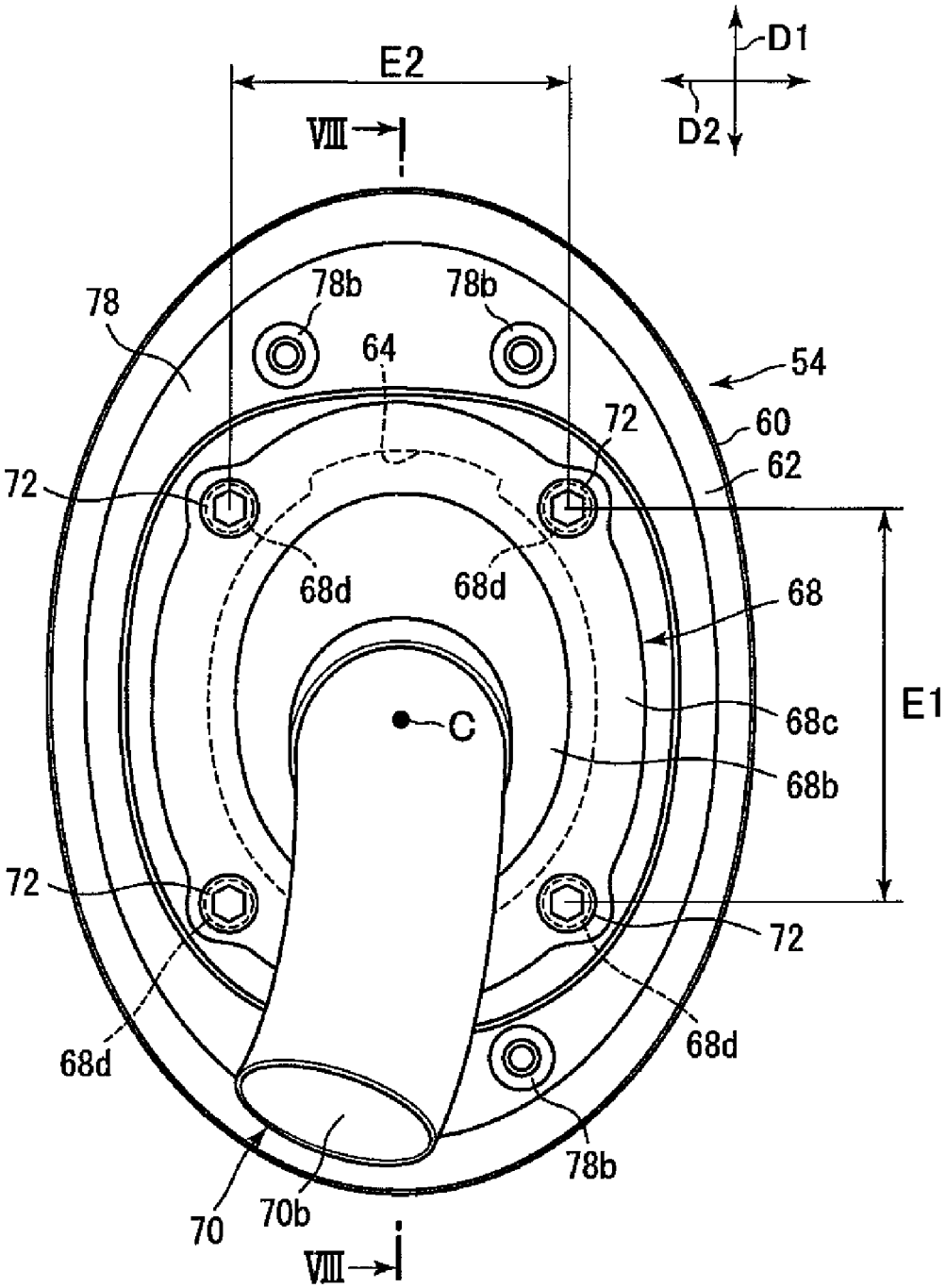
FIG. 7 is a rear view of an outer tube and a lid member which are included in the silencer.
Figure 8:
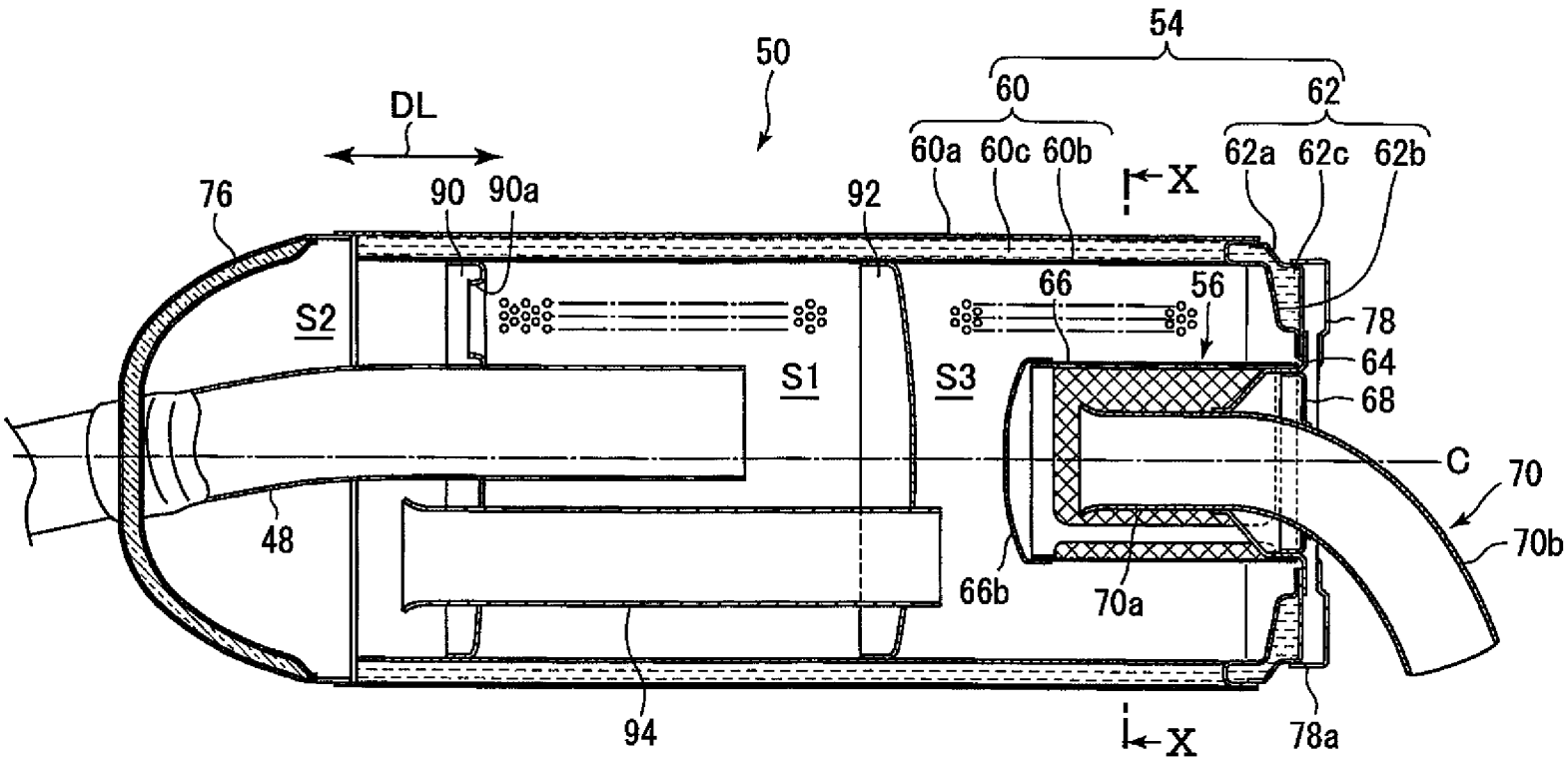
FIG. 8 is a sectional view of the silencer taken in lines VIII-VIII in FIG. 7.
Figure 9:
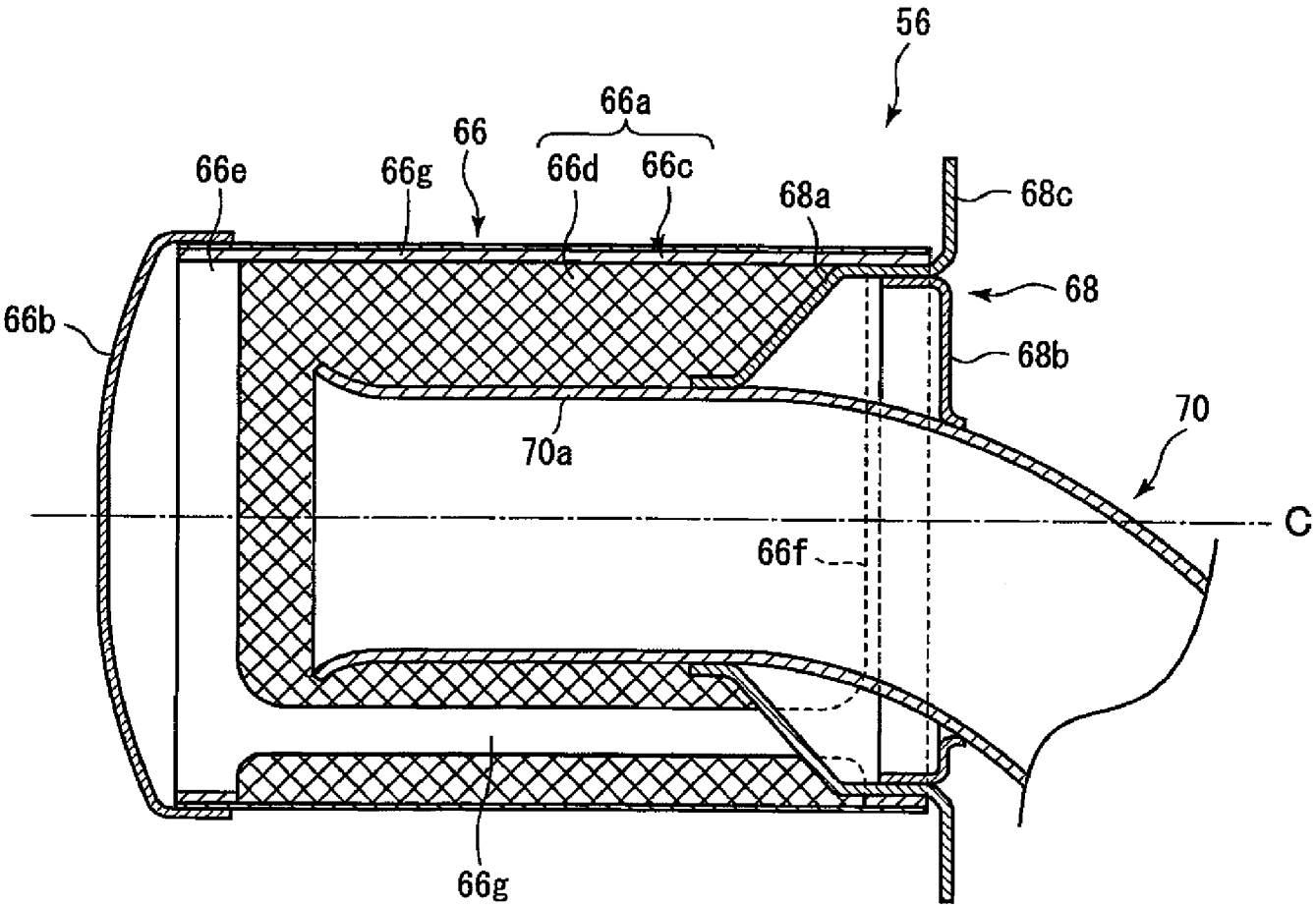
FIG. 9 is a sectional view of a spark arrester assembly.
Figure 10:
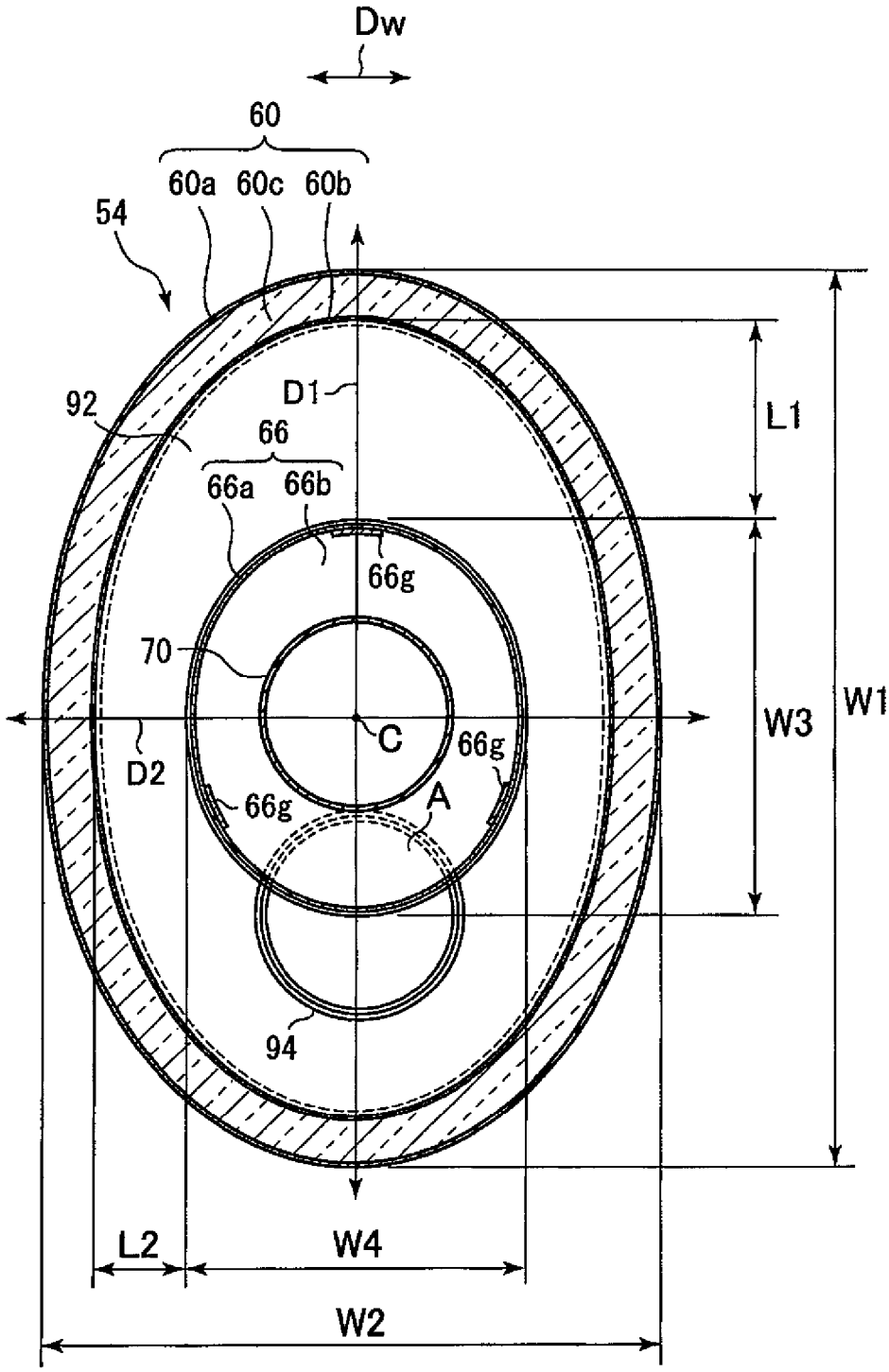
FIG. 10 is a sectional view of the silencer taken in lines X-X in FIG. 8.

FIG. 6 is an exploded perspective view showing a rear portion of the silencer 50. FIG. 7 is a rear view of an outer tube 54 and a lid member 68 included in the silencer 50. FIG. 8 is a sectional view of the silencer 50 taken in lines VIII-VIII in FIG. 7. FIG. 9 is a sectional view of a spark arrester assembly 56. FIG. 10 is a sectional view of the silencer 50 taken in lines X-X in FIG. 8.

As shown in FIG. 6 and FIG. 8, the silencer 50 includes an outer tube 54 and a spark arrester assembly 56.

The outer tube 54 constitutes an outer wall of the silencer 50. The outer tube 54 extends in the fore-aft direction of the motorcycle 10, and is disposed along the rear wheel 34. The outer tube 54 is longitudinally positioned (so that a longitudinal centerline C of the outer tube 54 extends (in Direction DL in FIG. 8)) substantially in parallel to the fore-aft direction (Direction F-R in FIG. 1) of the motorcycle 10. In the present preferred embodiment, the outer tube 54 is disposed so that the longitudinal direction of the outer tube 54 is the fore-aft direction of the motorcycle 10 in a plan view of the motorcycle 10. The outer tube 54 is disposed with its rear tipped up to a higher position than its front, so in a side view of the motorcycle 10, a longitudinal direction of the outer tube 54 is slanted with respect to the fore-aft direction of the motorcycle 10. As shown in FIG. 1, an upward-extending bracket 58 is mounted on an outer surface of the outer tube 54. The bracket 58 is attached to the seat frame 18, and the outer tube 54 is supported by the seat frame 18.

Referring to FIG. 6 and FIG. 8, the outer tube 54 includes a tubular circumferential wall portion 60 opening in a forward and a rearward direction, and a rear wall portion 62 provided at the rear edge of the circumferential wall portion 60. The circumferential wall portion 60 has a double structure. The circumferential wall portion 60 includes a tubular outer wall portion 60*a*; a tubular inner wall portion 60*b* disposed inside of the outer wall portion 60*a*; and an insulation member 60*c* stuffed between the outer wall portion 60*a* and the inner wall portion 60*b*. The rear wall portion 62 also has a double structure. The rear wall portion 62 includes an outer wall portion 62*a*; an inner wall portion 62*b* disposed inside of the outer wall portion 62*a*; and an insulation member 62*c* stuffed between the outer wall portion 62*a* and the inner wall portion 62*b*. The outer tube 54 includes an opening 64 in its rear. In the present preferred embodiment, the rear wall portion 62 includes the opening 64. The rear wall portion 62 includes a plurality (for example, four in the present preferred embodiment) of mounting holes 64*a* along an edge of the opening 64.

Referring to FIG. 9, the spark arrester assembly 56 includes a spark arrester 66, a lid member 68 and a tail pipe (exhaust path) 70.

The spark arrester 66 is disposed inside the outer tube 54, and reduces emission into the atmosphere of smut, etc. contained in the exhaust gas. The spark arrester 66 is tubular, and is longitudinally positioned (so that a longitudinal centerline C of the spark arrester 66 extends) in parallel or substantially in parallel to the longitudinal direction of the outer tube 54.

As shown in FIG. 9, the spark arrester 66 includes a tubular gas passage portion 66*a* and a front wall portion 66*b*. The gas passage portion 66*a* surrounds an outer circumferential surface of a front portion (a portion located inside the outer tube 54) 70*a* of the tail pipe 70, and is open in a forward and a rearward direction. The front wall portion 66*b* closes the gas passage portion 66*a* from the front. The front wall portion 66*b* has its edge bent toward the gas passage portion 66*a*, and fixed by welding, for example, to the gas passage portion 66*a*. The gas passage portion 66*a* and the front wall portion 66*b* define a structure of a rearward opening cup as a whole. The lid member 68 is attached to a rear of the spark arrester 66.

Referring also to FIG. 8, a rear edge of the spark arrester 66 (i.e., a rear edge of the gas passage portion 66*a* in the present preferred embodiment) is fixed to an outer circumferential surface of a tube portion 68*a* (to be described later) of the lid member 68 by welding, for example. Thus, the spark arrester 66 is supported by the lid member 68 inside the outer tube 54, and extends from the lid member 68 in a forward direction longitudinally of the outer tube 54. On the other hand, the spark arrester 66 has its fore end, i.e., the end closer to the front wall portion 66*b*, which is not fixed by any member. The spark arrester 66 is supported only on its rear end, in a cantilever fashion.

The gas passage portion 66*a* includes a mesh-structured member. Exhaust gas flowing inside the outer tube 54 passes through the gas passage portion 66*a* and then enters the tail pipe 70. As shown in FIG. 9, the gas passage portion 66*a* includes a frame 66*c*, and a mesh 66*d* fixed to the frame 66*c*. The frame 66*c* includes an annular portions 66*e*, 66*f*, and a plurality (for example, three in the present preferred embodiment; see FIG. 10) of post portions 66*g*. The annular portion 66*e* surrounds the centerline C at a front end of the frame 66*c* whereas the annular portion 66*f* surrounds the centerline C at a rear end of the frame 66*c*. The post portions 66*g* are provided between the annular portions 66*e* and 66*f*, circumferentially of the annular portions 66*e*, 66*f*, connecting the annular portions 66*e* and 66*f* with each other. The mesh 66*d* is wound around the outer side of the annular portions 66*e*, 66*f* to wrap around the post portions 66*g*, and is fixed to the annular portions 66*e*, 66*f* by welding, for example.

Referring also to FIG. 6, the lid member 68 is attached to the rear wall portion 62 from behind, along the edge of the opening 64 of the outer tube 54.

As shown in FIG. 9, the lid member 68 includes a tube portion 68*a* and a center wall portion 68*b*. The center wall portion 68*b* is fitted inside the tube portion 68*a*. The center wall portion 68*b* has its outer circumferential edge fixed to an inner surface of the tube portion 68*a* by welding, for example. The tube portion 68*a* includes a flange portion 68*c* at its rear end, extends from the flange portion 68*c* in a longitudinally forward direction, then tapers to have a reduced diameter, and extends further in the forward direction. The flange portion 68*c* includes a plurality (for example, four in the present preferred embodiment; see FIG. 6) of mounting portions, provided by mounting holes 68*d*, along the outer circumferential edge of the lid member 68.

Referring to FIG. 8, when the spark arrester assembly 56 is mounted to the outer tube 54, the spark arrester 66 supported by the lid member 68 is inserted through the opening 64, into the outer tube 54. Thereafter, the lid member 68 is attached to the rear wall portion 62, along an edge of the opening 64. By inserting a bolt 72 through each pair of the mounting holes 68*d* and 64*a*, the lid member 68 is mounted to the rear wall portion 62. By removing the bolts 72, the lid member 68 can be removed from the rear wall portion 62. It should be noted here that as shown in FIG. 6, a gasket 74 is inserted between an edge of the opening 64 and the flange portion 68*c* of the lid member 68 in order to prevent exhaust gas from escaping from between the opening 64 and the flange portion 68*c*.

As shown in FIG. 8 and FIG. 9, the tailpipe 70 is provided in the lid member 68. The tail pipe 70, which communicates with the inside of the spark arrester 66 and the outside of the outer tube 54, allows exhaust gas that has flown into the spark arrester 66 to get out of the outer tube 54. The tail pipe 70 has its front end opening inside the spark arrester 66. From the front end, the tail pipe 70 extends rearward through the lid member 68 and protrudes rearward from the outer tube 54. The tail pipe 70 is supported by both the tube portion 68*a* and the center wall portion 68*b* of the lid member 68. Specifically, the tube portion 68*a* has its front edge whereas the center wall portion 68*b* has an inner edge, and both of the edges are fixed to an outer circumferential surface of the tail pipe 70 by welding, for example. It should be noted here that a rear portion (a portion protruding from the outer tube 54) 70*b* of the tail pipe 70, i.e., a portion located at a more rearward position than the spark arrester 66, is curved downward and then ends with a downward opening. Referring to FIG. 6 and FIG. 7, each of the mounting holes 68*d* is preferably located at a position that avoids the rear portion 70*b* of the tail pipe 70. Specifically, the mounting holes 68*d* do not overlap the rear portion 70*b* of the tail pipe 70 when the spark arrester assembly 56 is viewed from behind.

As has been mentioned earlier, the spark arrester 66 and the lid member 68 are fixed to each other by welding, for example, and the lid member 68 and the tail pipe 70 are fixed to each other also by welding, for example. Therefore, the spark arrester 66, the lid member 68 and the tail pipe 70 can be handled as a single piece when assembling/disassembling the spark arrester 66 to/from the outer tube 54.

As shown in FIG. 10, in a sectional plane that is perpendicular or substantially perpendicular to the longitudinal axis of the outer tube 54 and the spark arrester 66, an outside dimension W1 of the outer tube 54 in a height direction (Direction D1) is greater than an outside dimension W2 of the outer tube 54 in a lateral direction (Direction D2).

Also, an outside dimension W3 of the spark arrester 66 in the height direction (Direction D1) in the sectional plane is greater than an outside dimension W4 of the spark arrester 66 in the lateral direction (Direction D2) in the sectional plane. Further, in the sectional plane, the spark arrester 66 has an outer circumference longer than an outer circumference of a true circle which has a diameter of the outside dimension W4. In the present preferred embodiment, the spark arrester 66 preferably has an elliptical section in the sectional plane. In this arrangement, the major axis of the elliptical section is the outside dimension W3 whereas its minor axis is the outside dimension W4.

Also, as shown in FIG. 10, in the sectional plane, the spark arrester 66 has a sectional shape which is relevant to the sectional shape of the outer tube 54 in the sectional plane. In the present preferred embodiment, the sectional shape of the outer tube 54 and the sectional shape of the spark arrester 66 obtained in the above-described section are both elliptical. Further, the ellipse defined by the spark arrester 66 and the ellipse defined by the outer tube 54 have their respective major axes oriented in the same direction. In the present preferred embodiment, these major axes are oriented in the height direction (Direction D1). Also, the ellipse defined by the spark arrester 66 and the ellipse defined by the outer tube 54 have their respective minor axes oriented in the same direction. In the present preferred embodiment, these minor axes are oriented in the lateral direction (Direction D2). It should be noted here that in the present preferred embodiment, the sectional shape of the spark arrester 66 is closer to a true circle than that of the outer tube 54 is. Therefore, a distance L1 between an inner surface of the outer tube 54 and the spark arrester 66 in the height direction (Direction D1) is greater than a distance L2 between the inner surface of the outer tube 54 and the spark arrester 66 in the lateral direction (Direction D2).

The outer tube 54 and the spark arrester 66 are on the same, common centerline C, i.e., they are coaxial with each other. In other words, the center of the outer tube 54 in the height direction (Direction D1) and the lateral direction (Direction D2), and the center of the spark arrester 66 in the height direction (Direction D1) and the lateral direction (Direction D2) are located at the same position.

It should be noted here that in the present preferred embodiment, the outer tube 54 is disposed with its rear tipped up to a higher position than its front, so the longitudinal direction (Direction D1) of the outer tube 54 is slanted with respect to the up-down direction of the motorcycle 10. On the other hand, the lateral direction (Direction D2) of the outer tube 54 is the same as the lateral direction of the motorcycle 10. Note, here, that the lateral direction (Direction D2) of the outer tube 54 is perpendicular or substantially perpendicular to both the longitudinal direction of the outer tube 54 and the height direction (Direction D1). Therefore, in an arrangement where the outer tube 54 is disposed obliquely so that its rear end is more outward in the width direction of the motorcycle 10, the lateral direction (Direction D2) of the outer tube 54 is slanted with respect to the width direction of the motorcycle 10.

As shown in FIG. 7, the opening 64 is preferably formed into a generally elliptical shape relevantly to the sectional shape of the spark arrester 66. Further, the generally elliptical figure of the opening 64 has a major axis oriented in the height direction (Direction D1) whereas its minor axis is oriented in the lateral direction (Direction D2). Therefore, a dimension of the opening 64 in the height direction (Direction D1) is greater than a dimension of the opening 64 in the lateral direction (Direction D2). The opening 64 which is preferably formed in a generally elliptical shape as described above has an advantage over an opening 64 which is formed in a polygonal shape in that tightening forces from bolts 72 are distributed more uniformly to near-edge portions of the opening 64 in the rear wall portion 62. Further, referring to FIG. 6 and FIG. 7, the lid member 68 is preferably formed to have a generally elliptical outer shape relevantly to the shape of the opening 64, in the present preferred embodiment.

Also, as shown in FIG. 7, the mounting holes 68*d* are spaced from each other along the outer circumferential edge of the flange portion 68*c*. In the present preferred embodiment, four mounting holes 68*d* are formed in the flange portion 68*c*, for example. The four mounting holes 68*d* are disposed in both upper and lower regions above and below the centerline C. Likewise, the four mounting holes 68*d* are disposed in both right and left sides of the centerline C. Two of these mounting holes 68*d* which are positioned along the height direction (Direction D1) are spaced from each other by a distance (E1 in FIG. 7), which is greater than a distance (E2 in FIG. 7) between two of the mounting holes 68*d* which are positioned along the lateral direction (Direction D2). When the motorcycle 10 is running, there are concomitant up and down movements, and the spark arrester 66 is subject to forces acting in the up/down direction. As a result, the lid member 68 is subject to a moment from the spark arrester 66 whose rear edge is fixed thereto. In the present preferred embodiment, two of the mounting holes 68*d* which are positioned along the height direction (Direction D1) are spaced from each other by a long distance (E1 in FIG. 7). Therefore, even when such a moment is acting, the load acting on each mounting hole 68*d* is reduced. The arrangement increases mounting strength of the spark arrester assembly 56.

Referring now to FIG. 1, FIG. 6 and FIG. 8, the silencer 50 includes a front lid member 76, support members 78, 80, a cover 82 and a protector 84.

The front lid member 76 is fixed to a front edge of the circumferential wall portion 60 in order to close the outer tube 54 from the front. The front lid member 76 includes a through-hole (not illustrated), through which the exhaust pipe 48 extends rearward inside the outer tube 54.

The cover 82 is attached to the rear wall portion 62 via the support members 78, 80 in order to cover the outer tube 54 from behind. Specifically, as shown in FIG. 6, the support member 78 preferably is a doughnut-shaped disc-like member, and is disposed to cover the rear wall portion 62 from behind. The support member 78 includes a plurality of leg portions 78*a* extending toward the rear wall portion 62 and fixed to the rear wall portion 62 by welding, for example. As shown in FIG. 6 and FIG. 7, the support member 78 includes a plurality (for example, preferably three in the present preferred embodiment) of rearward protruding mounting portions 78*b*. The support member 80 is attached to the mounting portions 78*b* with a plurality (for example, preferably three in the present preferred embodiment) of bolts 86. The cover 82 is attached to the support member 80 with a plurality (for example, preferably four in the present preferred embodiment) of bolts 88.

The protector 84 is attached to an outer surface of the circumferential wall portion 60 in order to cover the outer tube 54 from laterally outer side of the motorcycle 10.

Also, as shown in FIG. 8, inside of the outer tube 54 is partitioned into a plurality of expansion chambers. In the present preferred embodiment, the inside of the outer tube 54 is divided into three expansion chambers S1, S2, S3 by two partitioning walls 90, 92. The expansion chamber S2, the expansion chamber S1 and the expansion chamber S3 are located in the fore-aft direction in this order. The spark arrester 66 is located in the rearmost expansion chamber S3, and the expansion chamber S1 is adjacent thereto. The expansion chamber S3 represents the first expansion chamber whereas the expansion chamber S1 represents the second expansion chamber.

The exhaust pipe 48 has its rear end opening inside the expansion chamber S1, so exhaust gas from the exhaust pipe 48 expands first in the expansion chamber S1. The partitioning wall 90 which partitions the expansion chamber S2 and the expansion chamber S1 from each other includes a hole 90*a* which penetrates the partitioning wall 90, so the exhaust gas in the expansion chamber S1 flows through the hole 90*a*, to the expansion chamber S2. In the present preferred embodiment, a space enclosed by the partitioning wall 90, the front lid member 76 and the circumferential wall portion 60 is the expansion chamber S2. Inside the outer tube 54 a pipe 94 is disposed. The pipe 94, which extends longitudinally of the outer tube 54, penetrates the partitioning wall 90, and the partitioning wall 92 which partitions the expansion chamber S1 and the expansion chamber S3 from each other.

As shown in FIG. 8, a portion of the spark arrester 66 is located within a hypothetical extension of the pipe 94. More precisely, a portion of the front wall portion 66*b* in the spark arrester 66 is located within a hypothetical extension of the pipe 94. In other words, the front wall portion 66*b* is located at a rearward distance from the pipe 94, and a portion of the front wall portion 66*b* opposes an end of the pipe 94 longitudinally. Therefore, as shown in FIG. 10, when the spark arrester 66 and the pipe 94 are viewed from the longitudinal direction, the front wall portion 66*b* includes a portion (a lower portion in the present preferred embodiment) overlapping the pipe 94. The front wall portion 66*b* is made of a material which does not allow exhaust gas to flow through. In the present preferred embodiment, the front wall portion 66*b* is preferably made of a metal plate, for example. Therefore, exhaust gas from the pipe 94 hits and diffuses on the front wall portion 66*b*, i.e., a disturbance is created in the exhaust gas flow. As a result, the arrangement reduces concentrated flow of exhaust gas through a specific location in the spark arrester 66, thereby reducing clogging of the spark arrester 66.

Particularly in the present preferred embodiment, when the pipe 94 and the spark arrester 66 are viewed from the longitudinal direction, the pipe 94 is located at a lower position than the spark arrester 66 in the height direction (Direction D1). The spark arrester 66 preferably has an elliptical section as described earlier, with its major axis oriented in the height direction (Direction D1). In this arrangement, therefore, it is possible to have an increased area of the overlap region (Region A in FIG. 10) defined by the pipe 94 and the spark arrester 66 when the pipe 94 and the spark arrester 66 are viewed in the longitudinal direction.

According to the motorcycle 10 described so far, it is possible to increase the outside dimension of the spark arrester 66 in the height direction (Direction D1), and therefore it is possible to increase the surface area of the spark arrester 66 while reducing an increase in the outside dimension of the spark arrester 66 in the lateral direction (Direction D2). Since it is possible to increase the surface area of the spark arrester 66, there is no need for increasing the length of the spark arrester 66, which means that it is possible to reduce an increase in the length of the outer tube 54 (i.e., the length of the silencer 50) which holds the spark arrester 66 therein. Also, since it is possible to reduce an increase in the outside dimension of the spark arrester 66 in the lateral direction (Direction D2), it is possible to reduce an increase in the outside dimension of the outer tube 54 in the lateral direction (Direction D2) (i.e., the width of the silencer 50), and consequently, it is possible to reduce an increase in the width of the motorcycle 10. Also, since it is possible to reduce an increase in the width of the silencer 50, it is now possible to an increase the volume of the side case 52L which is disposed on the side of the silencer 50.

In a sectional plane including the height direction (Direction D1) and the lateral direction (Direction D2), the spark arrester 66 preferably has an elliptical sectional shape. Therefore, it is possible to increase the surface area of the spark arrester 66 compared to a spark arrester which has a true-circle section with a diameter equal to the outside dimension W4 of the spark arrester 66 in the lateral direction (Direction D2). Also, in cases where the surface area required of the spark arrester 66 is no more than the surface area of a true circle spark arrester, the spark arrester 66 can have a smaller outside dimension in the lateral direction (Direction D1) than the true circle spark arrester.

The opening 64 in the outer tube 54 is substantially elliptical, with its dimension in the height direction (Direction D1) being greater than the dimension in the lateral direction (Direction D2). This provides more uniform distribution of tightening forces from the bolts 72 in the outer wall portion 62*a* along the edge of the opening 64 than in cases where an opening 64 is preferably formed in a polygonal shape. The arrangement thus can prevent and minimize a potential gap development between the opening 64 and the lid member 68.

The lid member 68 preferably includes four mounting holes 68*d*, for example, along the outer circumferential edge of the lid member 68 for mounting to the outer wall portion 62*a*. In this arrangement, two of the mounting holes 68*d* which are positioned along the height direction (Direction D1) are spaced from each other by a distance E1, which is greater than a distance E2 between two mounting holes 68*d* which are positioned along the lateral direction (Direction D2). Since the spark arrester 66 has a cantilever structure, the lid member 68 is subject to a moment from the spark arrester 66 as the motorcycle 10 moves in up and down directions. However, by making the distance E1 greater than the distance E2, the arrangement reduces the load acting on each mounting hole 68*d* even under such a moment, and increases mounting strength of the spark arrester assembly 56.

The opening 64 in the outer tube 54 has a dimension in the height direction (Direction D1), which is greater than the dimension of the opening 64 in the lateral direction (Direction D2). The arrangement makes it easy to insert the spark arrester 66 through the opening 64.

When the pipe 94 and the spark arrester 66 are viewed from a longitudinal direction, at least a portion of the spark arrester 66 overlaps the pipe 94. Therefore, exhaust gas from the pipe 94 hits and diffuses the spark arrester 66. The arrangement reduces the concentrated flow of exhaust gas through a specific location in the spark arrester 66, thereby maintaining a good operating condition of the spark arrester 66 for a much longer period of time.

When the pipe 94 and the spark arrester 66 are viewed from a longitudinal direction, the pipe 94 is in the height direction (Direction D1) from the spark arrester 66. The arrangement makes it possible to increase the area of overlap region made by the pipe 94 and the spark arrester 66 when the pipe 94 and the spark arrester 66 are viewed from a longitudinal direction.

The front wall portion 66*b* of the spark arrester 66 is partially opposed to the end of the pipe 94 in the longitudinal direction of the outer tube 54. With this arrangement, the front wall portion 66*b* is made of a material which does not allow exhaust gas to flow through. Therefore, exhaust gas from the pipe 94 hits and diffuses further on the front wall portion 66*b* of the spark arrester 66.

The outer tube 54 and the spark arrester 66 are disposed coaxially with each other. The arrangement reduces such regions in the outer circumferential surface of the spark arrester 66 having an excessively small distance to the inner surface of the outer tube 54, and those regions having an unnecessarily large distance to the inner surface of the outer tube 54 as well.

In the sectional plane which includes the height direction (Direction D1) and the lateral direction (Direction D2), the spark arrester 66 has a sectional shape which is relevant to the sectional shape of the outer tube 54 in this sectional plane. The arrangement makes it possible to further reduce such regions in the outer circumferential surface of the spark arrester 66 having an excessively small distance to the inner surface of the outer tube 54, and those regions having an unnecessarily large distance to the inner surface of the outer tube 54 as well. The arrangement also makes it possible to increase the sectional shape in the sectional plane while maintaining the function as a spark arrester, enabling increase in the surface area of the spark arrester.

It should be noted here that the present invention is not limited to the above-described motorcycle 10, but may be varied in many ways. For example, in the preferred embodiment described above, the lid member 68 preferably includes four mounting holes 68*d*, for example. However, the number of the mounting holes 68*d* may be three, as in a silencer 50*a* shown in FIG. 11, or another suitable number.

Figure 11:
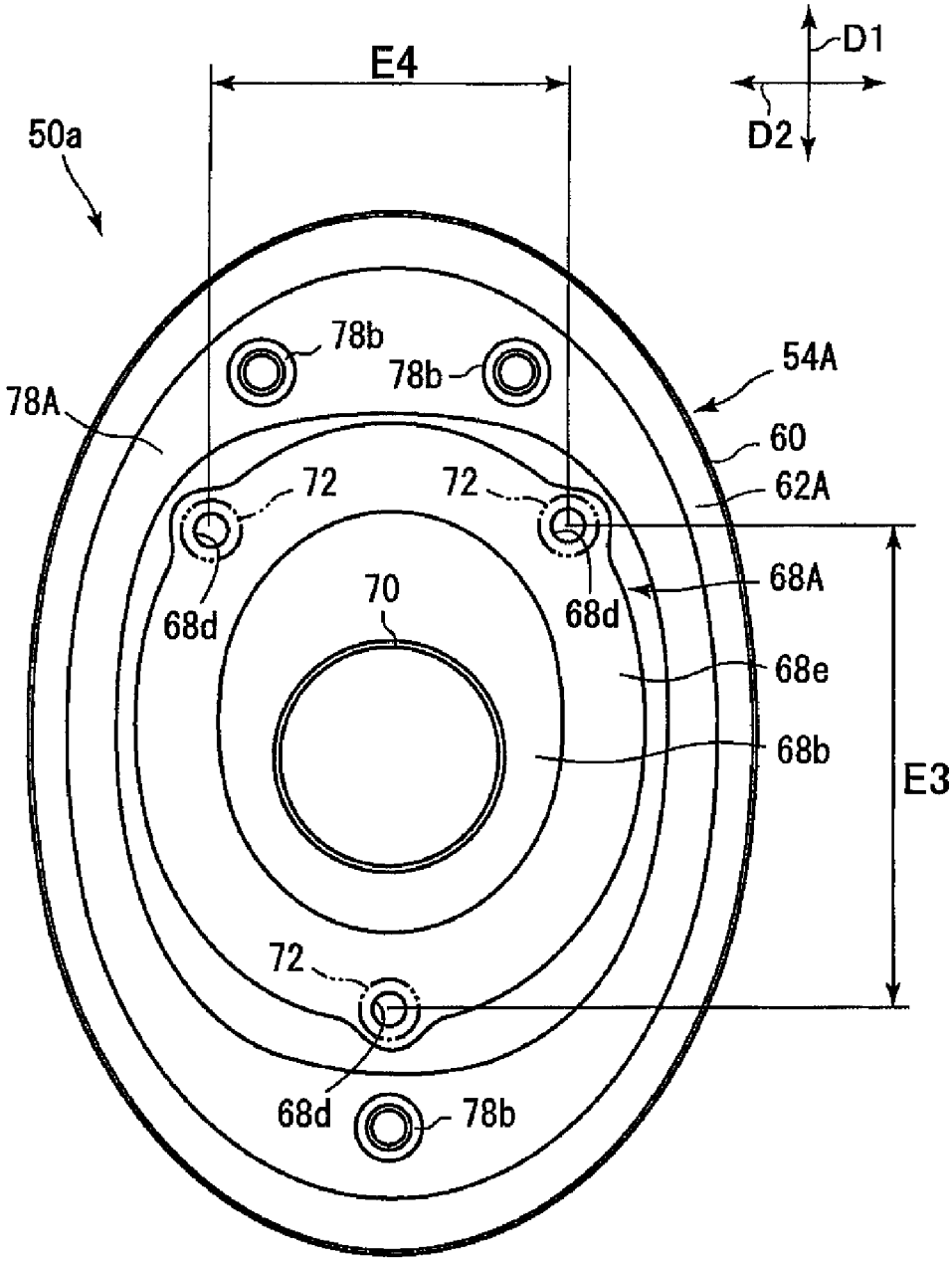
FIG. 11 is a rear view showing an outer tube, a lid member, etc. included in a silencer according to another preferred embodiment of the present invention.

FIG. 11 is a rear view of an outer tube 54A, a lid member 68A, etc., included in the silencer 50*a*. The lid member 68A includes a flange portion 68*e*, which includes three mounting portions provided by three mounting holes 68*d* spaced from each other along an outer circumferential edge of the flange portion 68*e*. In this case, the outer tube 54A includes a rear wall portion 62A which also preferably includes three mounting holes 64*a* though not illustrated in FIG. 11. The support member 78A preferably includes three mounting portions 78*b*, which are positioned appropriately near the mounting holes 68*d* of the lid member 68A.

In the lid member 68A, two mounting holes 68*d* which are positioned along the height direction (Direction D1), are spaced from each other by a distance E3, which is greater than a distance E4 between two mounting holes 68*d* which are positioned in the lateral direction (Direction D2). Therefore, even if the moment is acting from the spark arrester to the lid member as the motorcycle moves in up-down directions, the arrangement decreases the load acting on each individual mounting hole 68*d*, so the arrangement increases mounting strength of the spark arrester assembly.

Also, as shown in FIG. 10, in the motorcycle 10 described earlier, the spark arrester 66 has a sectional shape which is closer to a true circle than the sectional shape of the outer tube 54 is. Therefore, a distance L1 between the inner surface of the outer tube 54 and the spark arrester 66 in the height direction (Direction D1) is greater than a distance L2 between the inner surface of the outer tube 54 and the spark arrester 66 in the lateral direction (Direction D2). However, the spark arrester may be arranged so that the distance L1 is equal to the distance L2. Specifically, the spark arrester may have an elliptical section with a specific set of major axis and minor axis that makes the distance L1 equal to the distance L2. In this case, the arrangement reduces, further reliably, such regions in the outer circumferential surface of the spark arrester having an excessively small distance to the inner surface of the outer tube, and those regions having an unnecessarily large distance to the inner surface of the outer tube as well.

Figure 12:
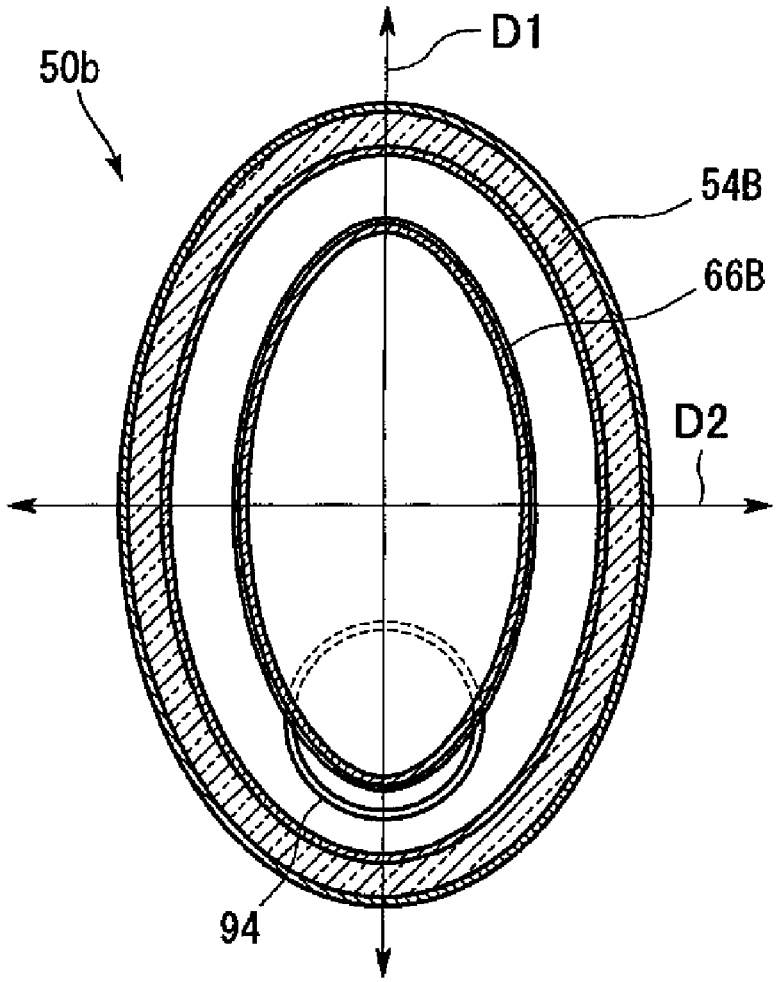
FIG. 12 is a sectional view of a silencer according to still another preferred embodiment of the present invention.

Further, the two sectional shapes may be like configurations as exemplified by a silencer 50*b* in FIG. 12, which includes an outer tube 54B and a spark arrester 66B having similar sectional shapes to each other. FIG. 12 is a sectional view of the silencer 50*b*. As shown in FIG. 12, in the silencer 50*b*, the outer tube 54B and the spark arrester 66B each have a sectional shape in a sectional plane which is perpendicular or substantially perpendicular to the longitudinal direction of the outer tube 54B and the spark arrester 66B, and these two sectional shapes are elliptical and similar to each other. By making the outer tube 54B and the spark arrester 66B have similar sectional shapes to each other as described, it becomes possible to reduce, even more reliably, such regions in the outer circumferential surface of the spark arrester 66B having an excessively small distance to the inner surface of the outer tube 54B, and those regions having an unnecessarily large distance to the inner surface of the outer tube 54B as well.

In the preferred embodiment described earlier, the outer tube and the spark arrester both preferably have elliptical sectional shapes. However, the sectional shape of the outer tube and of the spark arrester is not limited to elliptical. The shape may be generally polygonal as in a silencer 50*c* shown in FIG. 13 or in a silencer 50*d* shown in FIG. 14.

Figure 13:
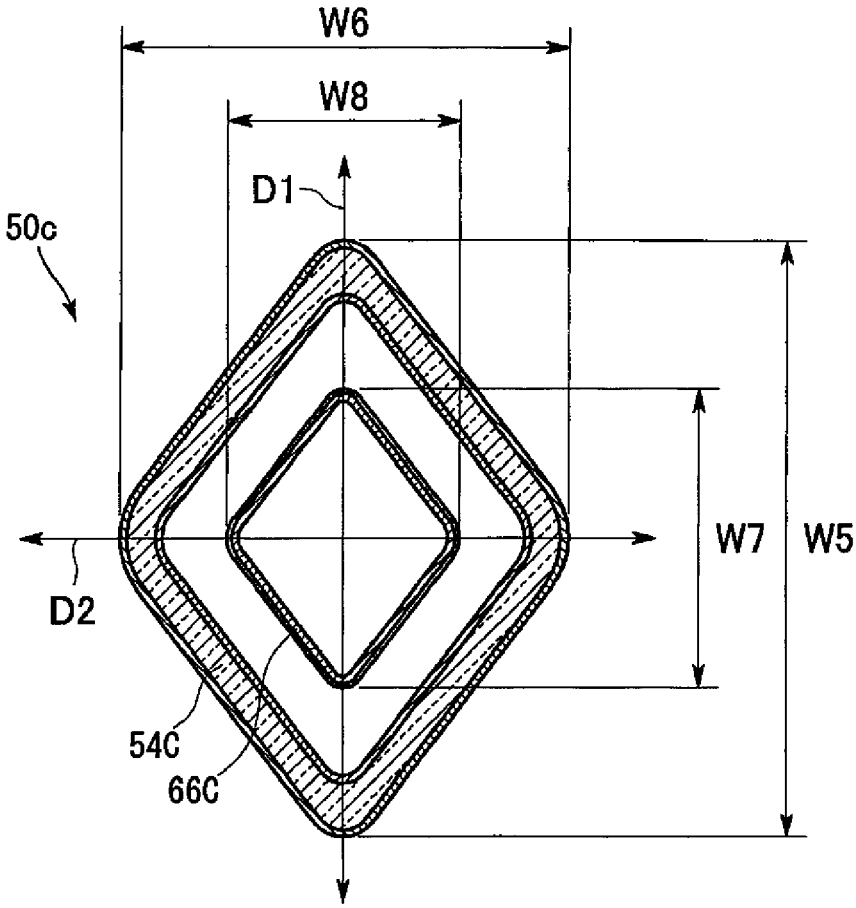
FIG. 13 is a sectional view of a silencer according to still another preferred embodiment of the present invention.
Figure 14:
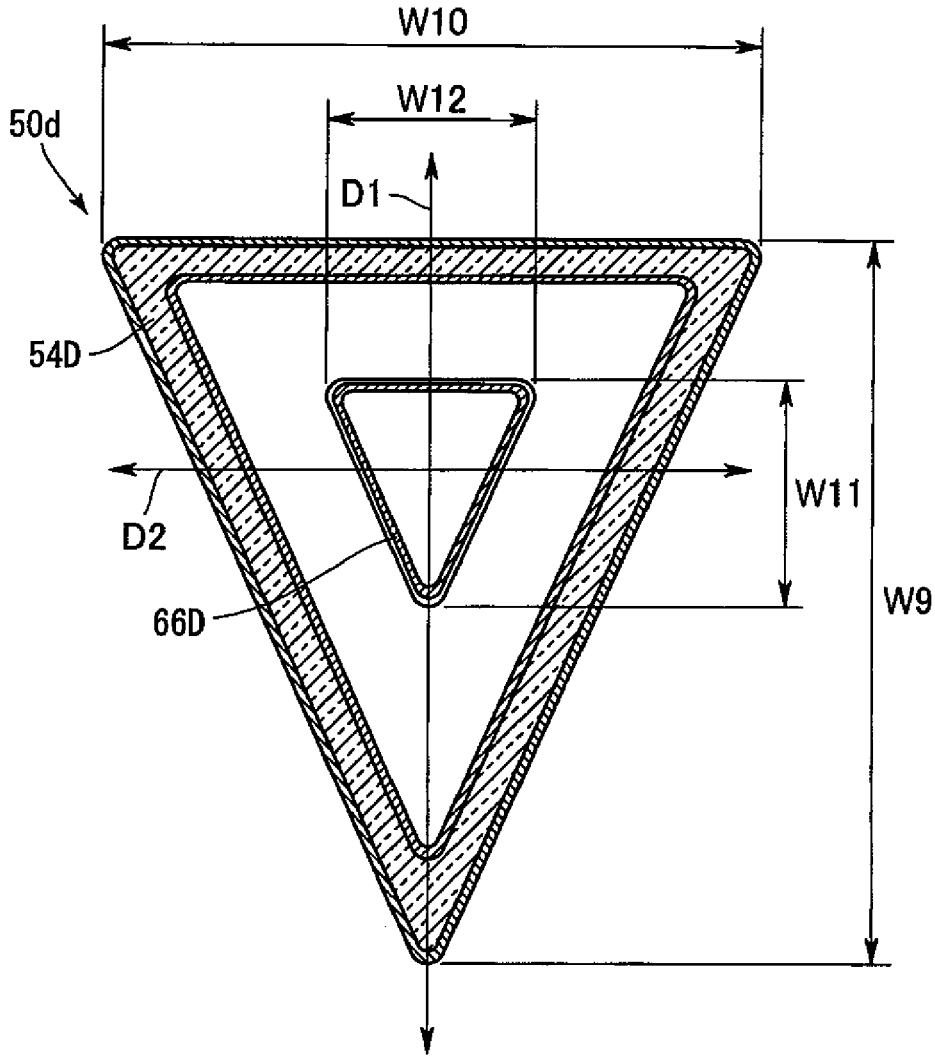
FIG. 14 is a sectional view of a silencer according to still another preferred embodiment of the present invention.

FIG. 13 is a sectional view of the silencer 50*c*. FIG. 14 is a sectional view of the silencer 50*d*.

As shown in FIG. 13, the silencer 50*c* includes an outer tube 54C and a spark arrester 66C. The outer tube 54C and the spark arrester 66C each have a sectional shape in a sectional plane which is perpendicular or substantially perpendicular to the longitudinal direction of the outer tube 54C and the spark arrester 66C, and these two sectional shapes are generally rectangular and similar to each other. In the present preferred embodiment, the outer tube 54C and the spark arrester 66C each preferably have a generally diamond-shaped sectional shape. In the arrangement, the outer tube 54C has an outside dimension W5 in the height direction (Direction D1), which is greater than an outside dimension W6 of the outer tube 54C in the lateral direction (Direction D2). Likewise, the spark arrester 66C has an outside dimension W7 in the height direction (Direction D1), which is greater than an outside dimension W8 of the spark arrester 66C in the lateral direction (Direction D2). Further, in the sectional plane which is perpendicular or substantially perpendicular to the longitudinal direction, the spark arrester 66C has an outer circumference longer than an outer circumference of a true circle which has a diameter of the outside dimension W8. It should be noted here that there may be an arrangement where the outer tube has a generally diamond-shaped section whereas the spark arrester has an elliptical section.

FIG. 14 shows a silencer 50*d*, which includes an outer tube 54D and a spark arrester 66D. The outer tube 54D and the spark arrester 66D each have a sectional shape in a sectional plane which is perpendicular or substantially perpendicular to the longitudinal direction of the outer tube 54D and the spark arrester 66D, and these two sectional shapes preferably are generally triangular. In the arrangement, the outer tube 54D has an outside dimension W9 in the height direction (Direction D1), which is greater than an outside dimension W10 of the outer tube 54D in the lateral direction (Direction D2). Likewise, the spark arrester 66D has an outside dimension W11 in the height direction (Direction D1), which is greater than an outside dimension W12 of the spark arrester 66D in the lateral direction (Direction D2).

Figure 15:
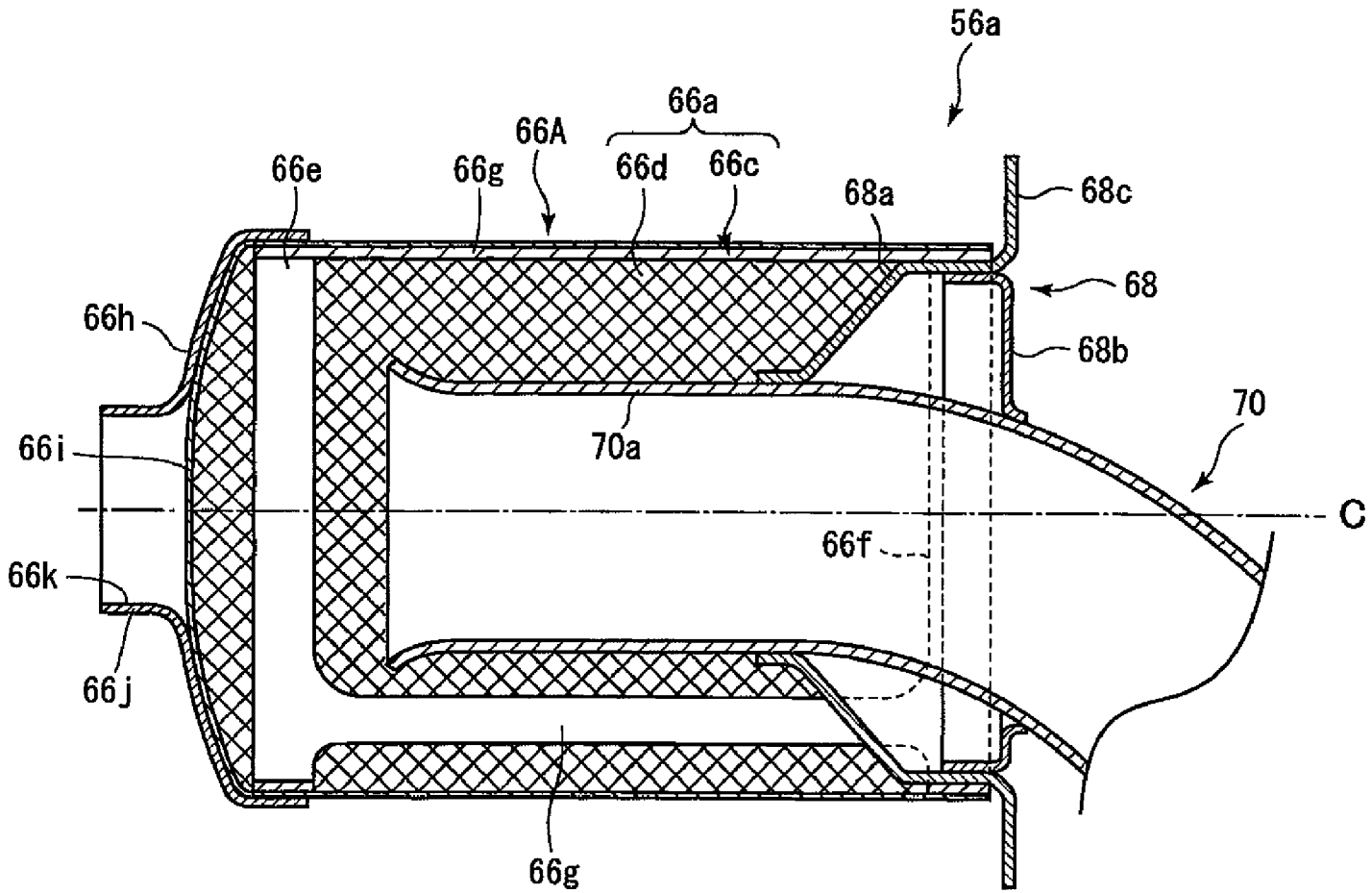
FIG. 15 is a sectional view of another spark arrester assembly.

Further, a spark arrester assembly 56*a* may be used which includes a spark arrester 66A as shown in FIG. 15. The spark arrester 66A includes a front wall portion 66*h* in place of the front wall portion 66*b* in the spark arrester 66, and a mesh 66*i*. The front wall portion 66*h* has a burring shape. The front wall portion 66*h* includes an axially protruding tubular portion 66*j* at its center portion, and a through-hole 66*k*. The mesh 66*i* is provided on an inner surface of the front wall portion 66*h*, closing the through-hole 66*k*.

By adding the mesh 66*i* as described, the arrangement increases the area of mesh within the spark arrester 66A. Since an increased area of mesh decreases resistance in airflow, the spark arrester 66A obtained from the arrangement achieves an increased performance. As a result, the spark arrester 66A can have a decreased length and/or diameter.

Also, since the front wall portion 66*h* includes the tubular portion 66*j* and has a burring shape, the arrangement prevents sparks in the exhaust gas from hitting the mesh 66*i* directly. As a result, sparks are not concentrated in any specific portion of the mesh 66*i*, so the arrangement reduces deterioration and clogging of the mesh 66*i*.

Further, the burring shape in the front wall portion 66*h* ensures sufficient strength of the spark arrester 66A.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A motorcycle comprising:

a rear wheel; and a silencer provided on a side of the rear wheel, wherein the silencer includes:

an outer tube; and a tubular spark arrester disposed inside the outer tube, with a longitudinal axis of the spark arrester oriented in a longitudinal direction of the outer tube; wherein in a sectional plane that is perpendicular or substantially perpendicular to the longitudinal direction of the outer tube and the spark arrester, the outer tube has an outside dimension in a height direction that is greater than an outside dimension of the outer tube in a lateral direction, and the spark arrester has an outside dimension in the height direction that is greater than an outside dimension of the spark arrester in the lateral direction; and the outer tube includes an opening in a rear portion thereof, the silencer further includes a lid member mounted at the rear portion of the outer tube along an edge of the opening and supporting the spark arrester inside the outer tube, the opening being generally elliptical and having a greater dimension in the height direction than a dimension in the lateral direction.

2. The motorcycle according to claim 1, wherein the spark arrester has an elliptical sectional shape in the sectional plane.

3. The motorcycle according to claim 1, wherein the lid member includes at least three mounting portions provided along an outer circumferential edge of the lid member to mount to the rear portion of the outer tube, two of the mounting portions spaced from each other in the height direction being spaced by a distance greater than a distance between two of the mounting portions spaced from each other in the lateral direction.

4. The motorcycle according to claim 1, wherein the outer tube includes, in an inside space thereof, a first expansion chamber with the spark arrester disposed therein, a second expansion chamber adjacent to the first expansion chamber, a partitioning wall partitioning the first expansion chamber and the second expansion chamber from each other, and a pipe extending in the longitudinal direction of the outer tube and penetrating the partitioning wall, and at least a portion of the spark arrester and the pipe overlap each other when the pipe and the spark arrester are viewed from the longitudinal direction.

5. The motorcycle according to claim 4, wherein the pipe is spaced in the height direction from the spark arrester when the pipe and the spark arrester are viewed from the longitudinal direction.

6. The motorcycle according to claim 4, wherein the spark arrester includes a front wall portion arranged to not allow exhaust gas to flow therethrough, and at least a portion of the front wall portion opposes an end of the pipe in the longitudinal direction.

7. The motorcycle according to claim 1, wherein the outer tube and the spark arrester are coaxial with each other.

8. The motorcycle according to claim 7, wherein the spark arrester has a sectional shape in the sectional plane that is relevant to a sectional shape of the outer tube in the sectional plane.

9. The motorcycle according to claim 8, wherein the sectional shape of the spark arrester is similar to the sectional shape of the outer tube.

10. The motorcycle according to claim 8, wherein the spark arrester and the outer tube are spaced from each other in the height direction by a distance which is equal to a distance between the spark arrester and the outer tube in the lateral direction.

* * * * *